United States Patent [19]

Elhaus

[11] 4,303,388

[45] Dec. 1, 1981

[54] PREHEATING FURNACE

[76] Inventor: Friedrich W. Elhaus, Jägerhofstr. 117a, D-5600 Wuppertal 1, Fed. Rep. of Germany

[21] Appl. No.: 86,206

[22] Filed: Oct. 18, 1979

[30] Foreign Application Priority Data

Jul. 19, 1979 [DE] Fed. Rep. of Germany ..... 2929322

[51] Int. Cl.[3] ..... F27D 3/00

[52] U.S. Cl. ..... 432/246; 198/782; 414/159; 432/236

[58] Field of Search ..... 432/124, 236, 239, 246, 432/8, 59; 198/782; 414/159; 266/107

[56] References Cited

U.S. PATENT DOCUMENTS

| | | | |
|---|---|---|---|
| 1,205,690 | 11/1916 | Wetcke | 414/159 |
| 1,525,905 | 2/1925 | Anthony | 414/159 |
| 1,695,224 | 12/1928 | Besta | 432/246 |
| 1,695,515 | 12/1928 | Uhrig | 432/239 |
| 1,881,184 | 10/1932 | Harris et al. | 414/159 |
| 2,167,640 | 8/1939 | Cope | 432/239 |
| 3,632,093 | 1/1972 | Elhaus | 432/137 |
| 3,837,794 | 9/1974 | Phillips | 432/8 |
| 4,049,372 | 9/1977 | Bloom | 432/246 |
| 4,065,249 | 12/1977 | Nelson | 432/8 |
| 4,109,782 | 8/1978 | Nakai | 198/782 |
| 4,134,487 | 1/1979 | Veragen | 198/782 |
| 4,153,236 | 5/1979 | Elhaus | 266/252 |

*Primary Examiner*—John J. Camby

*Attorney, Agent, or Firm*—Hume, Clement, Brinks, Willian & Olds, Ltd.

[57] ABSTRACT

A transport device in a preheating furnace for treating metallic material like bars, billets, blooms and the like of light metal, such as aluminum and its alloys, comprises a slide-in unit adapted to be pushed into and pulled out of the furnace chamber. The slide-in unit supports furnace rollers or slides for the material to be preheated. The slide-unit itself is displaceable preferably by sliding or rolling on rails. With the transport device the thermal efficiency is improved, as after charging the furnace all parts of the transport device are contained in the furnace chamber which may be in this manner completely sealed for the heat treatment of the material. Moreover, assembly and disassembly of the furnace rollers or slides is easy.

12 Claims, 2 Drawing Figures

PREHEATING FURNACE

The invention relates to a furnace for treating metallic material, in particular bars, billets, blooms, and the like of light metal, such as aluminum and its alloys, comprising a transport device for transportation of the material into and out of the furnace chamber.

A preheating furnace of this kind is known (German Pat. No. 18 07 504; U.S. Pat. No. 3,632,093) the transport device of which is an endless conveyor chain. The conveyor chain passes into the furnace at the loading end and out of the furnace at the discharge end for introducing the material to be preheated into the furnace and removing it from the same, respectively. As the conveyor chain takes heat out of the furnace to the outside, energy is wasted unnecessarily.

Furnaces are known in which furnace rollers or skids are supported in firmly installed bearings. As the temperatures inside the furnace chamber are high, the furnace rollers or skids are subject to heavy wear and must be exchanged frequently. This typically requires disassembly of the furnace. As the wear of the furnace rollers or skids and their bearing surfaces progresses, the material comes to lie deeper and deeper on the furnace. This is a disadvantage if the furnace is combined with a successive downstream means, such as a billet hot shearing means which requires exact alignment in level between the furnace and the successive means for proper operation, as this adjusted level is not maintained because of the wear.

Furthermore, the known furnaces comprising furnace rollers or skids cannot be emptied as they must always be completely full for loading and unloading.

It is the object of the invention to design a furnace of the kind initially mentioned such that the thermal efficiency is improved so that energy is saved and the other disadvantages are overcome.

To meet this object, it is provided, in accordance with the invention, that the transport device is formed by a slide-in unit adapted to be pushed into and pulled out the furnace chamber, and in that furnace rollers or skids are supported for easy assembly and disassembly on the slide-in unit.

The furnace according to the invention permits the slide-in unit to be moved out of the furnace chamber for exchange of the furnace rollers or skids so that then the furnace rollers or skids or their bearings can be replaced readily. In normal operation, however, the slide-in unit remains in the furnace chamber during the loading and unloading of the material so that no thermal energy can get to the outside via parts of the transport device.

Advantageously, the slide-in unit slides on rails or moves by means of rolls. In accordance with an advantageous further development of the furnace according to the invention the rails are provided so as to be adjustable in height in order to insure the same level of the material in the furnace chamber even if the furnace rollers or skids and/or their support should have become worn considerably.

Conveniently the slide-in unit is divided into a plurality of members adapted to be coupled to one another. With one embodiment of the invention each member comprises a support frame and a head piece which loosely rests on the same and is formed with supporting recesses for bearing pins provided at the furnace rollers. Conveniently bearing half shells are provided in these supporting recesses in order to receive the furnace rollers.

The members of the slide-in unit may be interconnectable by a pin coupling having a pin at one member and a hole formed in a fishplate at the other member to be engaged by the pin. As the slide-in unit is subdivided in accordance with the invention into several members, the total length of the slide-in manner is variable by coupling on or off individual members. However, as the furnace should always be full, the total length of the slide-in unit, as a rule, always will be the same. The division into individual members is advantageous above all as regards the possibility of servicing or exchanging furnace rollers and their support in sections. For this reason the rails laid outside of the furnace chamber need not correspond to the total length of the slide-in unit in this embodiment of the invention. The space requirement outside the furnace consequently is less and, at the utmost, may correspond to no more than the length of one member at the loading and/or unloading end.

The invention permits simpler exchange of the furnace rollers or skids than the known furnaces with stationary support of the furnace rollers in the furnace chamber. As the rails on which the slide-in unit rests inside and outside of the furnace chamber are adjustable in height, the alignment with a consecutive means, such as a billet hot shearing means may be kept at the same level and the maintenance or exchange of the furnace rollers or skids or their supporting may be effected at greater intervals.

The invention will be described further, by way of example, with reference to the accompanying drawings, in which.

Figure 2:
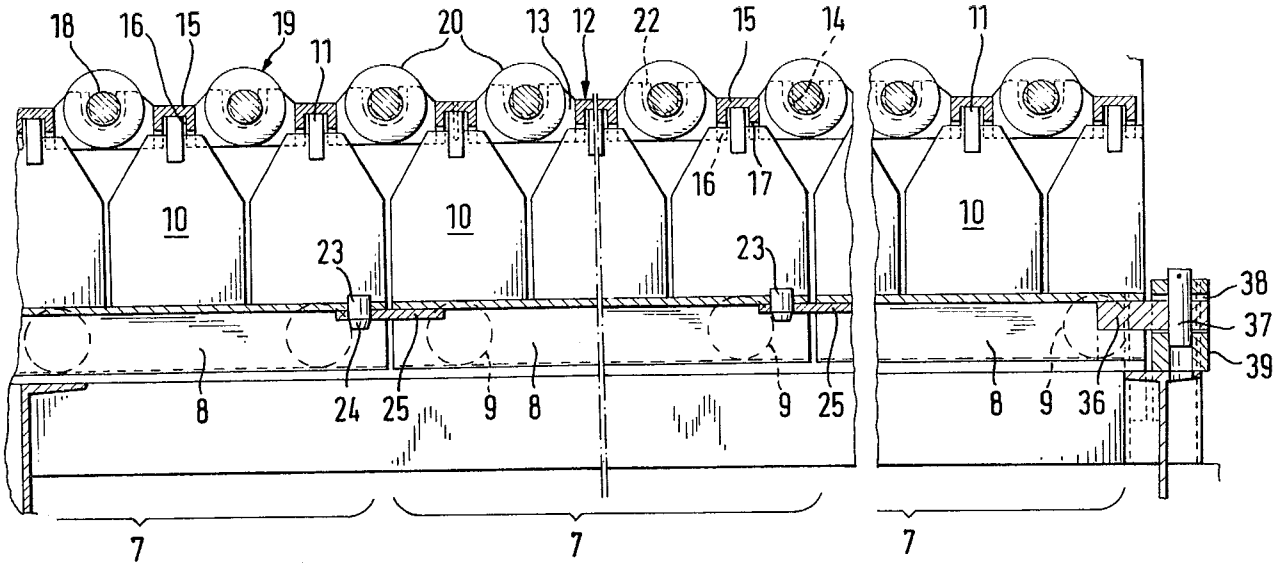
FIG. 2 shows a part sectional elevation in longitudinal direction through the transport device according to FIG. 1.

The preheating furnace shown comprises an outer casing 1 covering a furnace chamber 2 with furnace shells 3 supported on sealing base members 4, such as described in detail in German Pat. No. 18 07 504(U.S. Pat. No. 3,632,093). The furnace shells and the base members 4 leave a free continuous longitudinal slot 5 between them through which fits the support frame 6 of a member 7. A plurality of such members 7 are illustrated in FIG. 2. They each comprise an inverted U-shaped sectional bottom element 8 in the two legs of which running rolls 9 are supported at the longitudinal ends. Sectional wall elements 10 extend vertically upwardly from each sectional bottom element 8 and taper upwardly in side elevation according to FIG. 2 to carry transversely extending supports 11 at their tops. One head piece 12 each is placed on a plurality of such adjacent supports.

The head piece 12 is formed by a frame having longitudinal webs 13 and supporting recesses 14 as well as transverse webs 15 interconnecting the longitudinal webs 13. At their bottom sides the transverse webs 15 have recesses 16, the shape of which is complementary to the supports 11, and they have cut-outs 17 for passage of the highest areas of the wall elements 10.

Figure 1:
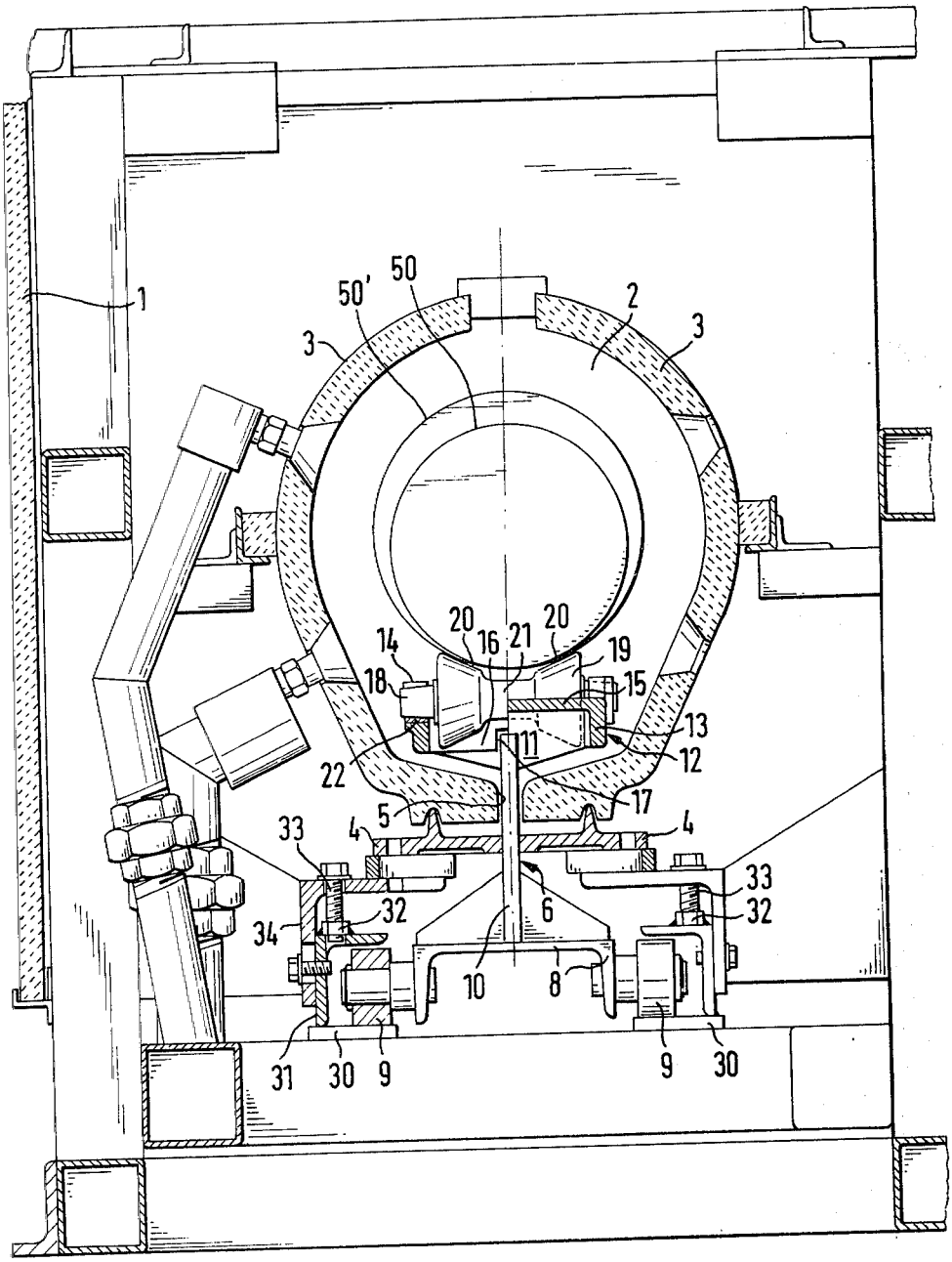
FIG. 1 shows a cross sectional elevation of a preheating furnace with a transport device according to the invention.

The supporting recesses 14 are conical in shape and so aligned with respect to each other in two opposed longitudinal webs 13 that they can take up the corresponding conical bearing pins 18 at both ends of a furnace roller 19 (cf. FIG. 1). Adjacent the bearing pins each furnace roller 19 has a running surface 20 which tapers conically toward the middle of the furnace roller and on which the material designated 50, 50' in FIG. 1 can roll off. Between the two running surfaces 20 the furnace roller is formed with a cylindrical collar section 21 of smaller diameter.

As best seen in FIG. 2, each sectional bottom element 8 comprises a pin 23 at one end projecting toward the bottom and having a conical insertable portion 24 and fitting into a hole in a fishplate 25 which is welded to the other end of the sectional bottom element 8 of the adjacent member 7. In this manner adjacent members 7 may be coupled and uncoupled in simple manner by lifting the end with the pin 23 and inserting the same into the hole in the fishplate 25 of the adjacent member.

Rolls 9 run on parallel rails.

The rails 30 for the rolls 9 are individually adjustable in height. For this purpose the rails 30 are connected to angular profile members 31, on the top surfaces of which nuts 32 are fixed by welding. Threaded bolts inserted through holes in a profile member 34 disposed at the furnace frame cooperate with the nuts 32 for adjustment of the height. Upon rotation of the threaded bolts 33 the angular profile members 31 slide in vertical direction along the profile members 34. In this manner the rails 30 may be adjusted in height in accordance with the degree of wear of the bearing pins 18 or running surfaces 20 of the furnace rollers. An exchange of the furnace rollers 19 consequently becomes necessary at relatively great intervals only.

Such exchange is made when at least one member 7 of the slide-in unit is moved out of the furnace chamber. Then the furnace rollers 19 are simply taken out of their supporting recesses 14 and replaced by new furnace rollers and, if desired, a bearing half shell 22 in the supporting recess 14 is exchanged.

In normal operation the slide-in unit with its members 7 remains in the furnace chamber during the loading and unloading. The material is introduced from the outside, for instance, by means of a roller bed at the loading end of the furnace and is removed from the same by another roller bed at the unloading end of the furnace.

The slide-in unit may be fixed in a certain position within the furnace chamber. To this end at least one member 7 (the right hand member in FIG. 2) includes a holding lug 36 at the sectional bottom element 8. This holding lug 36 has a bore into which a holding pin 37 may be driven which is provided at a stationary block 39 formed with a slot 38 to receive the holding lug 36. During normal operation the slide-in unit may thus be secured in a fixed position in the furnace chamber.

Various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

What I claim is:

1. A furnace for heating metallic material in bars, billets, blooms, and the like, comprising:

a furnace tunnel through which material to be heated is guided longitudinally, including an elongated opening along the lower section of said furnace tunnel;

means for guiding the material longitudinally through said furnace tunnel, said guiding means including at least two rollers on which the material is advanced, said rollers being positioned within said furnace tunnel along the longitudinal axis of the material to be heated, and each of said rollers having two running surface portions tapering towards each other and towards the center of the roller, said center having a cylindrical section of smaller diameter than the running surface portions; and means for supporting said guiding means, extending through said elongated opening, said supporting means being slidably mounted outside said furnace tunnel adjacent said guiding means for movement of said guiding means into and out of said furnace tunnel.

2. A furnace for heating metallic material in bars, billets, blooms, and the like, comprising:

a furnace tunnel through which material to be heated is guided longitudinally, including an elongated opening along the lower section of said furnace tunnel;

at least two rollers positioned within said furnace tunnel, said rollers being positioned along the longitudinal axis of the material to be heated so that the material is advanced on said rollers through said furnace chamber, and each of said rollers having two running surface portions tapering towards each other and towards the center of the roller, said center having a cylindrical section of smaller diameter than the running surface portions; and means for supporting said rollers, said supporting means having a portion extending from said rollers through said elongated opening and said supporting means being slidably mounted beneath said furnace tunnel such that said rollers are moved into and out of said furnace tunnel by movement of the supporting means.

3. The furnace of claims 1 or 2 wherein the furnace tunnel has a generally cylindrical configuration.

4. The furnace of claims 1 or 2 wherein said furnace tunnel includes a plurality of sectionally arranged semi-cylindrical fireproof shells which are positioned to form said lower elongated opening.

5. The furnace of claims 1 or 2 wherein said supporting means is mounted on rails by means of support rollers.

6. The furnace of claim 5 further including means for adjusting the height of the rails to accommodate wear of the support rollers.

7. The furnace of claims 1 or 2 wherein the supporting means is in modular form and includes means for coupling a plurality of support members so that the plurality of support members are moved into and out of the furnace tunnel together.

8. The furnace of claim 7 further comprising at least one pin coupling for connecting the plurality of support members, wherein the pin coupling includes a pin attached to one support member and engaging an apertured fishplate in an adjacent support member.

9. The furnace of claim 7 wherein each support member includes a support frame and a headpiece resting on the support frame, and the headpiece is provided with recesses for supporting bearing pins for the rollers.

10. The furnace of claim 9 further comprising bearing half shells mounted in the headpiece recesses for supporting the bearing pins for the rollers.

11. The furnace of claims 1 or 2 further comprising base members attached to said furnace, and wherein the supporting means is positioned within a longitudinal slot between the base members.

12. A furnace for heating metallic material in bars, billets, blooms, and the like comprising:

a furnace tunnel through which material to be heated is guided longitudinally, said tunnel including a plurality of sectionally arranged semicylindrical fireproof shells which are positioned to form an elongated opening along the lower section of said furnace tunnel, said shells also being provided with a plurality of holes disposed throughout the entire length of said furnace tunnel in axially extending rows in spaced-apart relationships;

burner means, inserted into said holes, having flame nozzles directed against the surface of the material to be heated;

means for guiding the material longitudinally through said furnace tunnel, said guiding means including at least two rollers on which the material is advanced, said rollers being positioned within said furnace tunnel along the longitudinal axis of the material to be heated, and each of said rollers having two running surface portions tapering towards each other and towards the center of the roller, said center having a cylindrical section of smaller diameter than the running surface portions; and means for supporting said guiding means, extending through said elongated opening, said supporting means being slidably mounted outside said furnace tunnel adjacent said guiding means for movement of said guiding means into and out of said furance tunnel.

* * * * *